US008276398B2

(12) United States Patent
Grabon et al.

(10) Patent No.: US 8,276,398 B2
(45) **Date of Patent: *Oct. 2, 2012**

(54) METHODS AND APPARATUS FOR REDUCING THE NOISE LEVEL OUTPUTTED BY OIL SEPARATOR

(75) Inventors: Michal Karol Grabon, Bressolles (FR); Xavier Girod, Montluel (FR); Eric Voluet, Saint-Denis (FR)

(73) Assignee: Carrier Corporation, Farmington, CT (US)

( * ) Notice: Subject to any disclaimer, the term of this patent is extended or adjusted under 35 U.S.C. 154(b) by 491 days.

This patent is subject to a terminal disclaimer.

(21) Appl. No.: 11/915,757

(22) PCT Filed: May 31, 2005

(86) PCT No.: PCT/US2005/018983

§ 371 (c)(1),
(2), (4) Date: Nov. 28, 2007

(87) PCT Pub. No.: WO2006/130134

PCT Pub. Date: Dec. 7, 2006

(65) Prior Publication Data

US 2008/0202151 A1 Aug. 28, 2008

(51) Int. Cl.
*F25D 19/00* (2006.01)
*F25B 43/00* (2006.01)
*F25B 23/00* (2006.01)

(52) U.S. Cl. ..... 62/296; 62/512; 62/470

(58) Field of Classification Search ..... 62/296, 62/470; 181/206, 253, 252, 256

See application file for complete search history.

(56) References Cited

U.S. PATENT DOCUMENTS

| | | | | |
|---|---|---|---|---|
| 2,003,543 | A * | 6/1935 | Jordan | 62/83 |
| 3,070,977 | A * | 1/1963 | Kimmel et al. | 62/473 |
| 3,633,377 | A * | 1/1972 | Quick | 62/192 |
| 4,331,001 | A * | 5/1982 | Jones | 62/503 |
| 4,730,695 | A | 3/1988 | Bar | |
| 5,007,499 | A * | 4/1991 | Ebbing et al. | 181/258 |
| 5,214,937 | A * | 6/1993 | Henrichs et al. | 62/468 |
| 5,784,784 | A | 7/1998 | Flanigan et al. | |
| 6,446,750 | B1 * | 9/2002 | Lewin | 181/256 |
| 6,840,746 | B2 * | 1/2005 | Marshall et al. | 417/312 |
| 7,017,706 | B2 * | 3/2006 | Brown et al. | 181/256 |
| 2001/0015302 | A1 * | 8/2001 | Lundgren | 181/252 |
| 2006/0123833 | A1 * | 6/2006 | Flanigan et al. | 62/470 |
| 2008/0179134 | A1 * | 7/2008 | Grabon et al. | 181/252 |

FOREIGN PATENT DOCUMENTS

| | | |
|---|---|---|
| CN | 2230816 | 7/1996 |
| CN | 1151487 | 6/1997 |
| JP | 08159619 | 6/1996 |
| WO | WO-9815789 | 4/1998 |

* cited by examiner

*Primary Examiner* — Frantz Jules
*Assistant Examiner* — Cassey D Bauer
(74) *Attorney, Agent, or Firm* — Cantor Colburn LLP

(57) ABSTRACT

A muffling apparatus (100) is provided for placement within an oil separator of refrigeration or cooling system, wherein the apparatus has a non-straight shape and a lumen (160) defined therein to allow for noise-creating pressure pulsations/waves to come into contact with absorbing material (110) of the muffling apparatus in order to attenuate the energy of the pressure waves/pulsations into heat and thus reduce oil separator vibrations caused thereby.

18 Claims, 3 Drawing Sheets

METHODS AND APPARATUS FOR REDUCING THE NOISE LEVEL OUTPUTTED BY OIL SEPARATOR

FIELD OF THE INVENTION

This invention relates to oil separators for use in refrigeration and cooling systems, and, in particular, to methods and apparatus for reducing the noise levels outputted by an oil separator that is located within a refrigeration or cooling system.

BACKGROUND OF THE INVENTION

As illustrated by FIG. 1, a water cooled chiller type refrigeration system 10 using a screw compressor 20 typically includes a condenser 30, a cooler 40, an oil separator 50, a condenser fan 60 and one or more expansion devices 70. The compressor 20 requires oil for lubrication, wherein the oil is typically entrained in a refrigerant. The combined oil and refrigerant mixture is carried through a compression cycle and discharged into the oil separator 50, where the oil must be removed from the refrigerant to allow for proper operation of the cooler 40. From the oil separator 50, the clean refrigerant flows to the condenser 30 and the separated oil is returned to the compressor 10.

Most known oil separators, such as those described in U.S. Pat. No. 5,704,215 to Lord et al. (the entirety of which is incorporated by reference herein), perform this separation function well. However, it has been observed that high noise levels are often generated in the vicinity of an oil separator 50 within a refrigeration system, such as the system 100 illustrated in FIG. 1. Without wishing to be bound by theory, it is believed that this is caused by high level pressure waves/pulsations (i.e., 250 Hz or above) emanating from the compressor 20 that are transferred to the oil separator 50, which acts like a resonant cavity and thus is excited by the compressor pulsations. This excitement causes high vibration levels at the surface of the oil separator 50, and that, in turn, translates into high noise levels outputted by the oil separator. These excess noise levels can be distracting and bothersome, or, even worse, can be damaging to the hearing of those working around the oil separator 50 and/or can be in violation of applicable noise ordinances.

Previous efforts by those in the art to reduce the high noise levels produced by an oil separator 50 have focused on placing noise reduction equipment or devices between the oil separator and the compressor 20. Often, however, such equipment is subjected to high pressure differentials between the compressor discharge within the equipment and the atmosphere outside of the equipment. In such instances, the noise reduction equipment functions, in essence, as a pressure vessel, thus implicating strict design rules, certifications, and by consequence, added costs. Moreover, the added noise reduction equipment causes the refrigeration/cooling system to occupy a larger overall footprint, which is suboptimal and can even outweigh any beneficial noise reduction that actually is achieved through use of the equipment.

Therefore, a need exists for methods and apparatus to reduce the noise output of an oil separator without interfering with the functioning of the oil separator or any other equipment utilized in connection with the refrigeration system, and wherein such methods and apparatus would not be plagued by any of the various drawbacks associated with muffling apparatus known in the art.

SUMMARY OF THE INVENTION

These and other needs are met by the present invention, which provides a muffling apparatus and methods for using the muffling apparatus to reduce the noise level output of an oil separator within a refrigeration or cooling system. The muffling apparatus is placed within an internal area of an oil separator and is at least partially formed of an absorbing material. The absorbing material is effective to attenuate the energy of pressure waves/pulsations from the compressor into heat, thus reducing the resultant vibrations of (and, in turn, noise levels outputted from) the oil separator caused by energy from the waves/pulsations.

The muffling apparatus has a tubular body comprised of an external shell that surrounds an internal layer and an internal shell. The muffling apparatus also has a first end, a second end and a lumen therebetween, wherein the lumen is surrounded by the internal shell and wherein the one or more portions of the muffling apparatus are adapted for connection to the internal area of an oil separator.

In an exemplary aspect of the present invention, the internal layer of the muffling apparatus is made of the absorbing material and the internal shell has a plurality of perforations/openings defined therein. Each opening provides a direct fluid/air pathway from the lumen to the internal layer of absorbing material. The purpose of the openings is to enable the pressure waves/pulsations that propagate through the lumen of the muffling apparatus to come into contact with the internal layer of absorbing material, thus enabling the absorbing material to attenuate the pressure waves/pulsations.

In another exemplary aspect of the present invention, the muffling apparatus has a non-straight shape, such as a bent shape or a curved shape. Its non-straight shape ensures that any pressure wave/pulsation, regardless of the direction it propagates, will come into contact with the internal layer of absorbing material via the lumen openings as the wave/pulsation passes though the lumen.

Still other aspects, embodiments and advantages of the present invention are discussed in detail below.

BRIEF DESCRIPTION OF THE DRAWINGS

For a fuller understanding of the nature and desired objects of the present invention, reference is made to the following detailed description taken in conjunction with the accompanying figures, wherein like reference characters denote corresponding parts throughout the views, and in which.

DETAILED DESCRIPTION

The present invention provides a muffling apparatus and methods of using the apparatus to reduce the noise level output produced by an oil separator of a refrigeration or cooling system, such as a water-cooled chiller type refrigeration system. In use, the muffling apparatus of the present invention is placed within an oil separator in order to attenuate pressure waves/pulsations that emanate from the compressor of the refrigeration system. As noted above, such waves/pulsations are believed to be responsible for creating vibrational forces that cause the oil separator surface to vibrate and, in turn, to disadvantageously generate high noise levels in its vicinity. Attenuation occurs during use of the muffling apparatus of the present invention because the pressure waves/pulsations come into contact with an absorbing material located within the muffling apparatus. The absorbing material dissipates/attenuates the energy of the pressure waves/pulsations into heat and thus reduces the resultant vibrations of (and, in turn, noise levels outputted from) the oil separator that are caused by energy from the pressure waves/pulsations.

The muffling apparatus of the present invention has many benefits. In particular, not only does the muffling apparatus successfully reduce oil separator noise levels, but it does so while being sited within an oil separator, thus not requiring the refrigeration/cooling system to occupy added space and not exposing the muffling apparatus to high pressure differentials.

Figure 1:
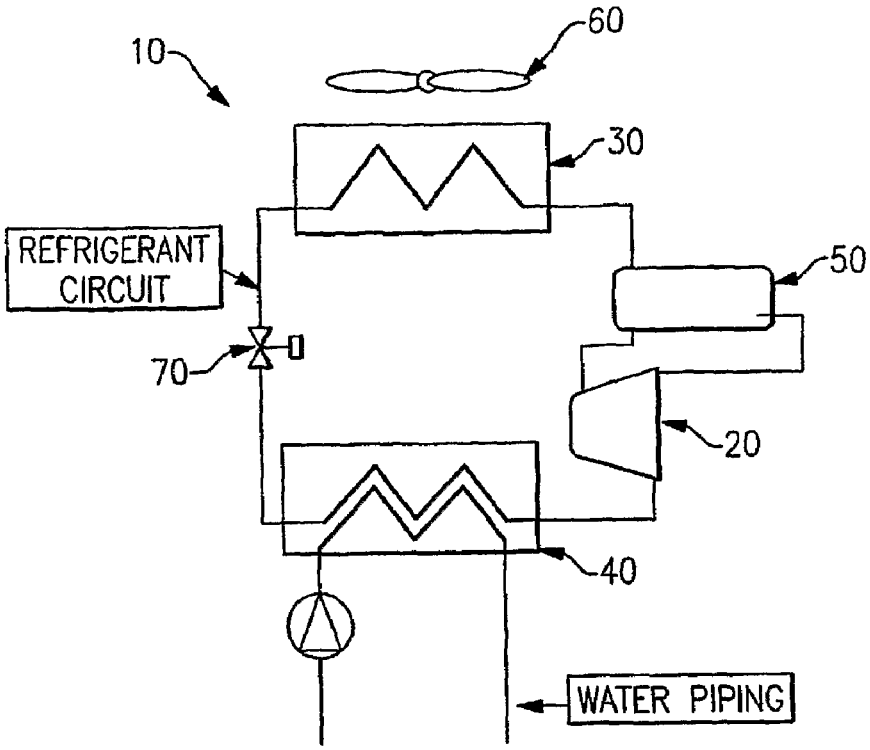
FIG.1 Prior Art
FIG. 1 is a schematic view of a known exemplary arrangement of a refrigeration/cooling system utilizing an oil separator.
Figure 2:
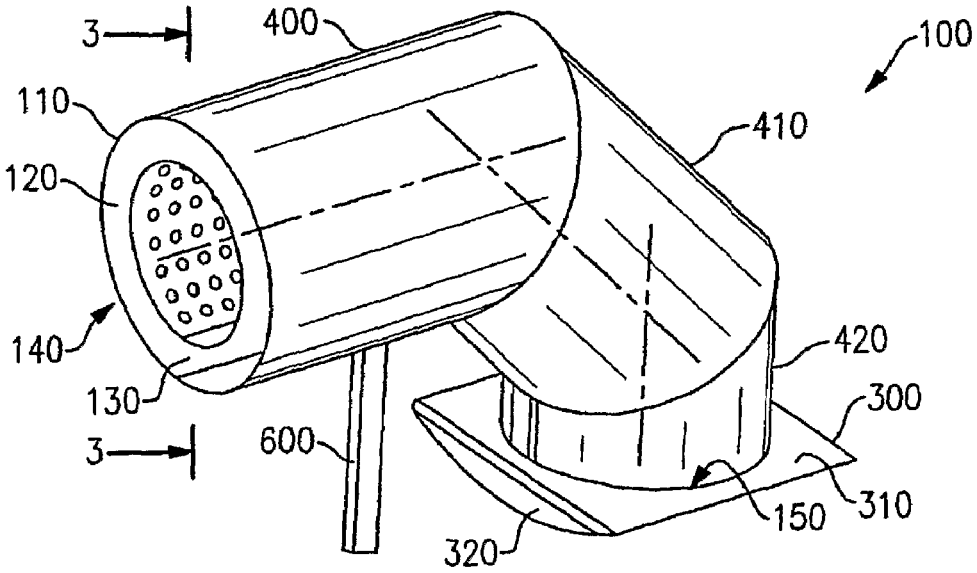
FIG. 2 is a perspective view of an exemplary embodiment of an oil separator muffling apparatus in accordance with the present invention.
Figure 3:
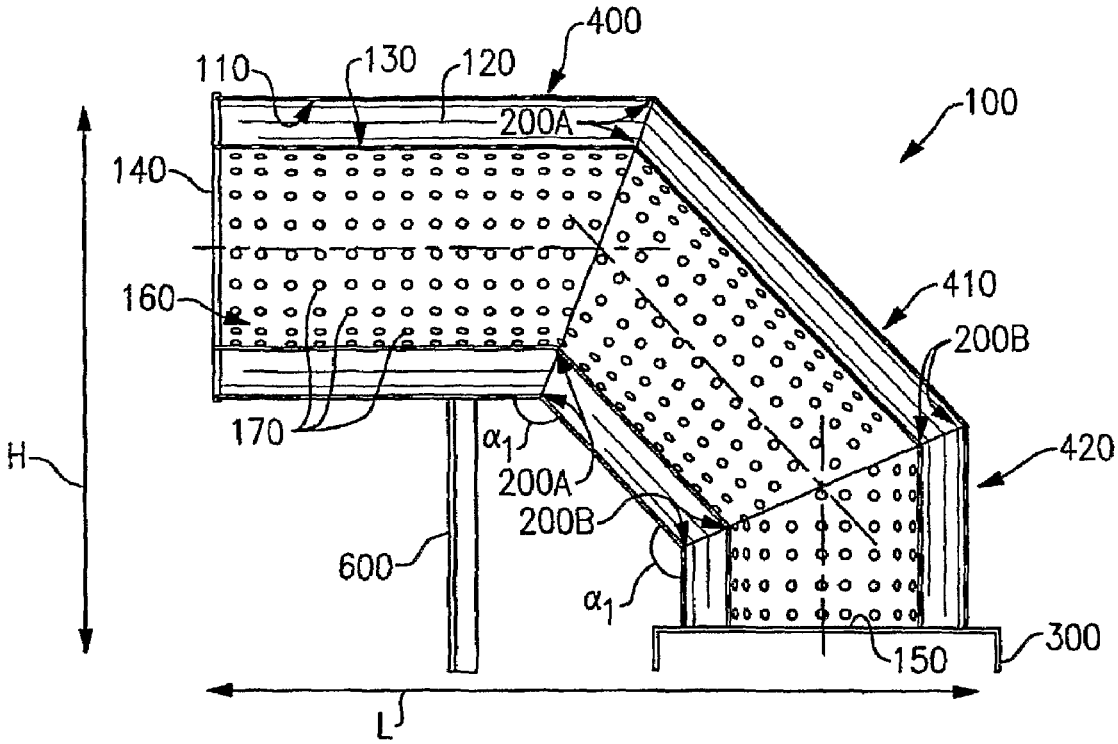
FIG. 3 is a side, cross-sectional view of the muffling apparatus of FIG. 2 taken along line 3-3 of FIG. 2.

FIGS. 2 and 3 depict an exemplary oil separator muffling apparatus 100 in accordance with the present invention. As best shown in FIG. 3, the muffling apparatus 100 has a tubular body comprised of an external shell 110 that surrounds an internal layer 120, wherein the internal layer has an internal shell 130—that is, the external shell and the internal shell "sandwich" the internal layer. Although it is currently preferred for the number and arrangement of the shells 110, 130 and the internal layer 120 of the muffling apparatus 100 to be as shown in FIGS. 2 and 3, it is also within the scope of the present invention for the muffling apparatus to be comprised of more or fewer layers and/or more or fewer shells than are depicted in the Figures, and/or for the layer(s) and/or the shell(s) to have a different arrangement than that which is shown.

Figure 4:
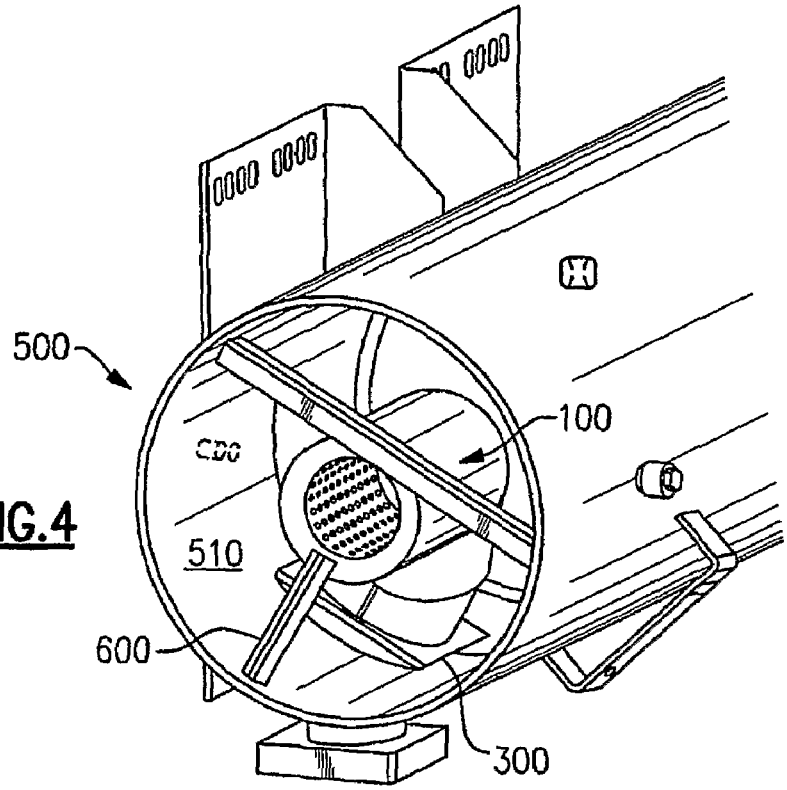
FIG. 4 is a perspective view, with partial cut away, of an exemplary oil separator wherein the muffling apparatus of FIGS. 2 and 3 has been placed within an internal area thereof.

The muffling apparatus 100 has a first end 140, a second end 150 and a lumen 160 therebetween, wherein the lumen is surrounded by the internal shell 130. The second end 150 of the muffling apparatus 100 is adapted for connection to an internal area 510 of an oil separator 500, as is shown in FIG. 4 and as will be described in further detail below. As is currently preferred in accordance with the present invention, the first and second ends 140, 150 of the muffling apparatus 100 have similar sized (i.e., similar diameter) lumen openings; however, that is not a requirement of the present invention.

To enable the muffling apparatus 100 to successfully reduce the noise level output of an oil separator in which it is placed, at least one of the external shell 110, the internal layer 120 and the internal shell 130 of the muffling apparatus should be made, at least partially, of a material that will absorb the energy from pressure waves (that emanate from the compressor and are transferred to the oil separator) and dissipate/attenuate that energy into absorbable heat. According to a currently preferred embodiment of the present invention, the internal layer 120 of the muffling apparatus 100 is made of such an absorbing material. The specific choice of the absorbing material can vary according to several factors, including but not limited to cost, dumping characteristics, availability and designer preference. According to an exemplary embodiment of the present invention, the absorbing material is a fiberglass material. A currently preferred fiberglass material is comprised of glass fibers with a phenolic resin, wherein the material has a density in the range of about 86 kg/m$^3$ to about 105 kg/m$^3$ and a maximum temperature of about 177° C.

The material(s) from which the external shell 110 and the internal shell 130 are constructed should be strong and durable, yet inexpensive. The external shell 110 and the internal shell 130 can be constructed of different or identical materials; however, according to an exemplary embodiment of the present invention, both the external shell 110 and the internal shell 130 are constructed of a sheet metal material. A currently preferred sheet metal material is steel, but other metal-based materials can be utilized as well.

As shown in FIGS. 2 and 3, the internal shell 130 has a plurality of perforations or openings 170 defined therein. Each opening 170 provides direct fluid communication between the lumen 160 and the internal layer 120 of absorbing material. The purpose of the openings 170 is to enable the pressure waves/pulsations that are propagating/passing through the lumen 160 of the muffling apparatus 100 to come into contact with the internal layer 120 of absorbing material, thus enabling the absorbing material to attenuate the pressure waves/pulsations.

The size, shape, number and spacing interval of the openings 170 can vary depending on several factors, including, but not limited to, the frequency of the pressure waves/pulsations that are expected to be encountered. According to a currently preferred embodiment of the present invention, openings 170 are defined in a range of about 10% to about 50% of the overall surface area of the internal shell 130. Also, although the openings 170 can have any shape and any spacing interval, it is currently preferred for the openings to be substantially round and spaced apart from each other at substantially identical distances, as best shown in FIG. 3.

The size and the shape of the muffling apparatus 100 also can vary; however, it is currently preferred that the muffling apparatus 100 have a non-straight shape. For example, FIGS. 2 and 3 depict a muffling apparatus that has a bent shape. Without wishing to be bound by theory, it is believed that a non-straight shape will be more likely, as compared to a straight shape, to successfully reduce oil separator noise levels that result from pressure waves/pulsations causing the oil separator to vibrate. This is thought to be due to the fact that such pressure waves tend to propagate in multiple directions, including substantially straight, upon entering the lumen 160 of the muffling apparatus 170. If a pressure wave was to propagate straight though the lumen of a straight muffling apparatus, then it would be possible for the straight wave to enter, travel though, and emerge from the muffling apparatus without having come into contact with the internal layer 120 via openings 170. If that was to occur, then the pressure wave would not be attenuated and the resultant noise level due to that wave would not be reduced. If, instead, the muffling apparatus 100 has a non-straight shape, as it does in accordance with the present invention, then any pressure wave, regardless of the direction it propagates, will come into contact with the internal layer 120 via openings 170 at some point as the wave passes though the lumen 160 of the muffling apparatus.

The non-straight shape of muffling apparatus 100 is further preferred because it enables the apparatus to have a larger size (as compared to an apparatus with a straight shape) while still fitting within the space confines of an oil separator. That allows for a longer lumen 160 to be defined between the first end 140 and the second end 150 of a bent apparatus, thus providing added opportunities for a pressure wave to come into contact with the internal layer 120 via openings 170.

As is currently preferred, the non-straight muffling apparatus has at least one bend point. For example, the muffling apparatus 100 of FIGS. 2 and 3 has a plurality of bend points 200A, 200B (as best shown in FIG. 3), wherein the bend angles, $\alpha_1$, $\alpha_2$ created at several of the bend points are both about 135°. The number of bend points can vary from that which is shown, as can their location and/or that of the bend angle(s) defined thereby.

According to an exemplary embodiment of the present invention, each of the bend points 200A, 200B is also a connection point—that is, a first segment 400 of the muffling apparatus 100 is connected to a second segment 410 of the muffling apparatus at the first bend points 200A, and the second segment of the muffling apparatus is connected to a third segment 420 of the muffling apparatus at the second bend points 200B. Such connections can be made as is generally known in the art, e.g., through the use of welding and/or rivets. It should be noted, however, that in accordance with the present invention the number of bend points can be less or greater than the number of connection points.

Figure 5:
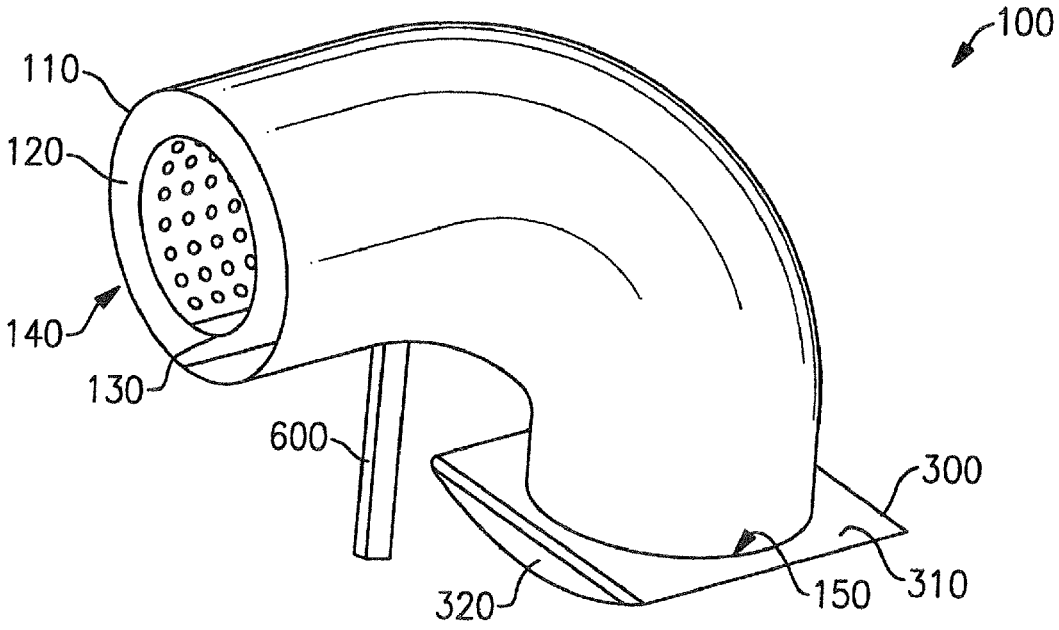
FIG. 5 is a perspective view of another exemplary embodiment of an oil separator muffling apparatus in accordance with the present invention.

The muffling apparatus can have other non-straight shapes, such as a curved shape, which also would be preferred as compared to a straight shape. In accordance with an embodiment of the present invention in which the muffling apparatus 100 has a curved shape, it is currently preferred for the muffling apparatus to have one continuous segment, as shown in FIG. 5, rather than several connected segments.

Referring again to FIG. 2, the second end 150 of the muffling apparatus 100 is attached (e.g., by welding) to a securing area 300 that is sized and shaped to enable the muffling apparatus to be secured to an internal area 510 of an oil separator 500 (see FIG. 4). In an exemplary embodiment of the present invention, the securing area 300 is an end plate, which has a flat portion 310 to which the second end 150 of the muffling apparatus 100 is attached. The end plate 300 also has a curved portion 320, wherein the rounded shape of the curved portion more readily enables the muffling apparatus 100 to be reliably secured to the rounded internal area 510 of an oil separator 500. The securing area 300 is generally made of a metal-based material (e.g., steel) and can be secured to the oil separator 500 using techniques known in the art, including, but not limited to, brazing, welding and/or through the use of rivets.

Optionally, and as shown in the Figures, a support element 600 can be attached (e.g., by welding) to both the first segment 400 of the muffling apparatus 100 and to the internal area 510 of the oil separator 500. The presence of the support element 600 provides added support to the muffling apparatus 100 by bearing the weight of the first segment 400. The support element 600 can be made of a variety of materials, including, but not limited, to one or more metal-based materials (e.g., steel).

The size of the muffling apparatus 100 can vary depending on several factors, most notably the size of the oil separator in which the muffling apparatus is installed. It is currently preferred for the size of the muffling apparatus 100 to vary proportionally with the size of the oil separator. For example, the muffling apparatus 100 will have a different predetermined size in order to fit within a 14 inch oil separator than it would to fit within a 16 inch oil separator or an 18 inch oil separator, wherein the size of the muffling apparatus for a 16 inch oil separator generally will be approximately 16/14 times the size of the muffling apparatus for a 14 inch oil separator and approximately 16/18 times the size of the muffling apparatus for an 18 inch oil separator.

According to an exemplary embodiment of the present invention in which the muffling apparatus 100 is placed in a 14 inch oil separator, the effective height, H (see FIG. 3), occupied by the muffling apparatus is in the range of about 7.5 inches to about 9.5 inches, with an effective height of about 8.5 inches being currently preferred, and the effective length, L (see FIG. 3) occupied by the muffling apparatus is in the range of about 11 inches to about 13.5 inches, with an effective height of about 13.2 inches being currently preferred. For placement within a 16 inch oil separator, these measurements would be approximately 16/14 times those for the 14 inch oil separator, and for placement within an 18 inch oil separator, they would be approximately 18/14 times those for the 14 inch oil separator.

Experiments were conducted to assess the noise reduction efficacy of a muffling apparatus 100 of the present invention. The experiments were performed in accordance with the guidelines of International Organization for Standardization (ISO 9614). The results of the experiments are shown in Table I below:

TABLE I

| Pressure Wave (octave in Hz) | 125 | 250 | 500 | 1000 | 2000 | 4000 |
|---|---|---|---|---|---|---|
| Acoustic change (dB) due to presence of muffling apparatus | −10 | −15 | −9 | −6 | −10 | −14 |

Global dBA = −8

To accumulate the test results in Table I, a refrigeration system was first operated such that its oil separator encountered six different pressure wave frequencies (125 Hz, 250 Hz, 500 Hz, 1000 Hz, 2000 Hz and 4000 Hz) emanating from its compressor, wherein the noise level outputted by the oil separator in response to each of these pressure wave levels was measured and recorded. A muffling apparatus 100 of the type shown in FIGS. 2 and 3 was then installed within the oil separator and the testing conditions were repeated to gather comparable data.

The experimental results in Table I demonstrate that there was an acoustic reduction at each pressure wave frequency level due to the presence of the muffling apparatus 100, wherein the acoustic reduction was calculated as the difference between the acoustic level at the oil separator without a muffling apparatus versus the acoustic level at the same oil separator with a muffling apparatus of the present invention installed within an internal area thereof. Therefore, the −10 dB measurement at 125 Hz indicates that the noise level measurement taken after the muffling apparatus 100 was installed within the oil separator was 10 dB less than the measurement taken when the same oil separator was not equipped with the muffling apparatus. The Global dBA of −8 dBA also supports that there was an acoustic reduction, and that the dominant frequency band of the pressure waves/pulsations was in the range of about 500-1000 Hz.

The results in Table I are very favorable. In particular, significant noise reduction levels were observed for each of the six selected pressure wave frequency bands. This is important because different compressors operate at different dominant pressure output levels, and thus would produce different Global dBA measurements.

Thus, a muffling apparatus 100 of the type shown in FIGS. 2 and 3 can be installed in an oil separator with confidence that the noise level reduction will be at least 6 dB, with a noise reduction level of up to 15 dB being possible as well depending on the dominant frequency band of the pressure/wave pulsations emanating from the compressor. These are significant noise reduction levels, especially when considering the effects of exposure to the reduced noise level over the lifetime of the refrigeration system in which the oil separator is located. Moreover, a noise reduction level of between 6 dB and 15 dB will be even more significant if, as is commonly the case, multiple refrigeration systems that include oil separators are installed in close proximity.

Although the present invention has been described herein with reference to details of currently preferred embodiments, it is not intended that such details be regarded as limiting the scope of the invention, except as and to the extent that they are included in the following claims—that is, the foregoing description of the present invention is merely illustrative, and it should be understood that variations and modifications can be effected without departing from the scope or spirit of the invention as set forth in the following claims. Moreover, any document(s) mentioned herein are incorporated by reference in their entirety, as are any other documents that are referenced within the document(s) mentioned herein.

We claim:

1. A method for reducing the noise level outputted by an oil separator within a refrigeration or cooling system, comprising:

providing a muffling apparatus that includes a tubular body being at least partially comprised of an absorbing material and having a non-straight shape wherein the muffling apparatus has a first aperture and a second aperture with a lumen defined between the first and second aperture, and a securing element directly attached to the first or second aperture of the tubular body; and placing the muffling apparatus within an internal area of an oil separator such that the securing element attaches directly to a rounded internal area of the oil separator.

2. The method of claim 1, wherein the non-straight shape is selected from the group consisting of a bent shape and a curved shape.

3. The method of claim 1, wherein at least a portion of the absorbing material is in direct fluid communication with the lumen.

4. The method of claim 3, wherein at least a portion of the absorbing material is in direct fluid communication with the lumen via a plurality of openings.

5. The method of claim 1, wherein the second aperture of the muffling apparatus is attached to a first end of the securing element, and wherein a second end of the securing element is attached to the internal area of the oil separator.

6. The method of claim 5, wherein the first end of the securing element is comprised of a flat end plate and the second end of the securing element is comprised of a curved portion to mate against the rounded internal area of an oil separator.

7. The method of claim 1, wherein the muffling apparatus is attached to a first end of a support element, and wherein a second end of the support element is attached to the internal area of the oil separator.

8. The method of claim 1, wherein the absorbing material is a fiberglass material.

9. A muffling apparatus for placement within an internal area of an oil separator, the muffling apparatus comprising:

a muffler body having a first aperture, a second aperture and a lumen therebetween, wherein the muffler body is at least partially constructed of an absorbing material, the muffler body having a non-straight shape; and a securing element having a first end and a second end, the second end of the muffler body attached directly to the first end of the securing element, the second end of the securing element attached directly to a rounded internal area of the oil separator, the first end of the securing element being an end plate.

10. The muffling apparatus of claim 9, wherein at least a portion of the absorbing material is in direct fluid communication with the lumen.

11. The muffling apparatus of claim 9, wherein the muffler body is comprised of:

an external shell;

an internal layer formed at least partially of the absorbing material, wherein the internal layer is surrounded by the external shell; and an internal shell, wherein the internal shell surrounds the lumen.

12. The muffling apparatus of claim 11, wherein the internal layer has a plurality of openings defined therein to enable direct fluid communication between the absorbing material and the lumen.

13. The muffling apparatus of claim 9, wherein the absorbing material is a fiberglass material.

14. The muffling apparatus of claim 11, wherein each of the external shell and the internal shell is made of a sheet metal material.

15. The muffling apparatus of claim 11, wherein the non-straight shape is selected from the group consisting of a bent shape and a curved shape.

16. The muffling apparatus of claim 9, wherein the second end of the securing element is curved.

17. The muffling apparatus of claim 9, wherein the muffling apparatus is attached to a first end of a support element, and wherein a second end of the support element is attached to the internal area of the oil separator.

18. The muffling apparatus of claim 9, wherein the securing element includes a flat plat, the first end of the securing element being located at the flat plate, the securing element including a curved portion extending perpendicular to the flat plate, the second end of the securing element being located at the curved portion.

* * * * *